United States Patent [19]

Shimizu

[11] Patent Number: 4,596,186

[45] Date of Patent: Jun. 24, 1986

[54] MECHANISM FOR CORRECTING THE TWIST OF A PLATE ON A PRINTER

[75] Inventor: Shigeru Shimizu, Takarazuka, Japan

[73] Assignee: Hamada Printing Press Mfg. Co., Ltd., Osaka, Japan

[21] Appl. No.: 782,265

[22] Filed: Sep. 30, 1985

[30] Foreign Application Priority Data

Nov. 22, 1984 [JP] Japan ..... 59-248315

[51] Int. Cl.[4] ..... B41F 7/22; B41F 27/06

[52] U.S. Cl. ..... 101/248; 101/415.1

[58] Field of Search ..... 101/415.1, 378, 410, 101/375, 376, 395

[56] References Cited

U.S. PATENT DOCUMENTS

| | | | |
|---|---|---|---|
| 3,168,040 | 2/1965 | Norton | 101/415.1 |
| 3,583,318 | 6/1971 | Stevenson | 101/415.1 |
| 4,100,851 | 7/1978 | Jahn | 101/248 |

*Primary Examiner*—J. Reed Fisher

*Attorney, Agent, or Firm*—Wenderoth, Lind & Ponack

[57] ABSTRACT

Mechanism for correcting the twist of a plate on a printer without removing the plate from a plate cylinder is proposed. A bracket having claws for holding one end of the plate is supported on a block with pins on the block received in oblique grooves formed in the bracket. When the block moves axially, the bracket will be skewed because it is prevented from moving axially. Accordingly the plate is skewed in such a direction as to eliminate any twist.

1 Claim, 7 Drawing Figures

MECHANISM FOR CORRECTING THE TWIST OF A PLATE ON A PRINTER

The present invention relates to mechanism for correcting the twist of a printing plate on a printer.

On an offset printer, ink supplied to a printing plate wound around a plate cylinder is transferred to a blanket cylinder pressed against the plate cylinder. For plates, metal plates or paper plates are used. Either plate is wound around the plate cylinder and usually supported thereon at both ends. However, since a paper plate is soft and has good adhesiveness to the plate cylinder when soaked with ink, it may be supported thereon at its front end only.

In winding a plate around the plate cylinder to start printing, it must be naturally mounted in a correct position with respect to the plate cylinder. On the other hand, in making a plate, it is very difficult to print a pattern on a plate in a centered position. The pattern is often printed in a twisted position with respect to the four sides of the plate. In such a case, even if the plate is mounted accurately in a correct position with respect to the plate cylinder, the pattern printed on the plate would be in a twisted position with respect to the plate cylinder. This makes it impossible to obtain good printed matter. It is, therefore, customary to make several trial prints and, according to the results, adjust the position of the plate in circumferencial, widthwise and oblique (to correct any twist) directions. Among three kinds of adjustments, the last one for twist correction is very troublesome because it requires removal of the plate from the plate cylinder for each adjustment.

An object of the present invention is to provide mechanism for correcting any twist of the plate without removing the plate from the plate cylinder, on a printer on which the plate is supported on the plate cylinder at one end thereof.

In accordance with the present invention, there is provided a mechanism for correcting the twist of a plate on a printing machine having a plate cylinder, the mechanism comprising a cylinder support shaft for supporting the plate cylinder; a bracket having a claw for clamping the plate at one end thereof; a block for supporting the bracket, the block being mounted on the cylinder support shaft so as to be rotatable and slidable in an axial direction; the bracket being supported on the block with a slight gap left between the ends of the bracket and the inner faces of the plate cylinder to allow the bracket to be skewed; one of the bracket and the block being formed with a pair of grooves oblique in opposite directions and the other being formed with a pair of pins adapted to be received in the pair of oblique grooves; a twist adjust shaft mounted in the cylinder support shaft and coupled with the block so that the block is axially movable when the twist adjust shaft is moved axially; and means for moving the twist adjust shaft axially.

With the mechanism according to the present invention, an axial movement of the twist adjust shaft causes an axial movement of the bracket support block along the cylinder support shaft. Since the gaps between the ends of the bracket and the respective end plates of the plate cylinder are very small, the bracket will soon abut the inner face of the end plate of the plate cylinder and be prevented from moving axially. Since the bracket support block moves axially further in this state, the bracket will skew around its center so that the plate held by the claws on the bracket will be skewed to eliminate any twist.

Other objects and features of the present invention will become apparent from the following description taken with reference to the accompanying drawings, in which.

Figure 1:
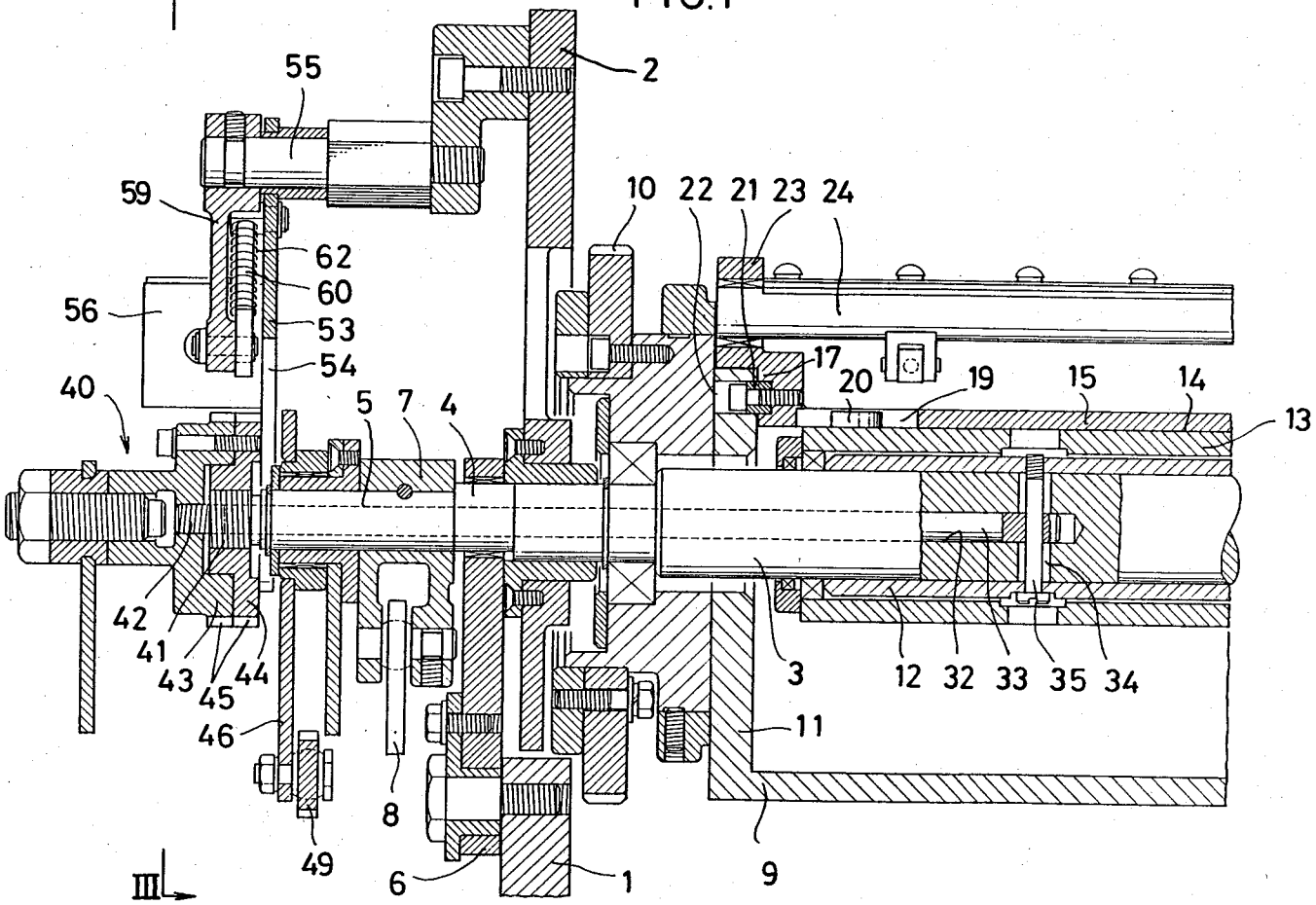
FIG. 1 is a vertical sectional front view of the mechanism embodying the present invention.
Figure 2:
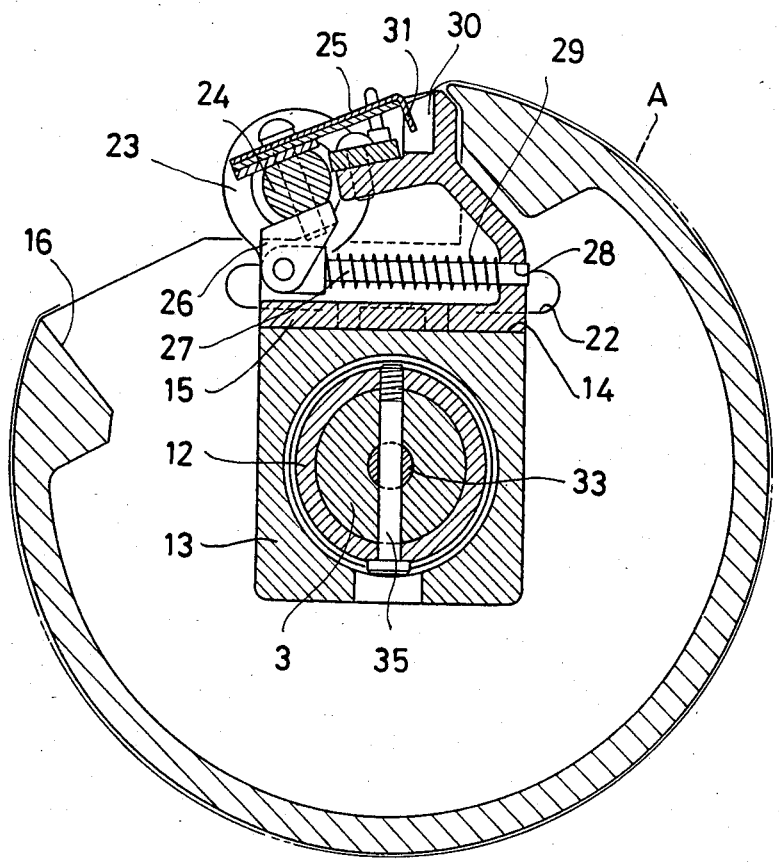
FIG. 2 is a vertical sectional side view thereof.

Referring to FIGS. 1 and 2, over a stationary side frame 1 is disposed a movable side frame 2 on which one end of a shaft 3 for supporting a plate cylinder 9 is rotatably mounted. At the one end of the shaft 3 is provided an eccentric shaft 4 at one end of which a small-diameter shaft 5 is formed. An arm 6 for rotatably supporting the eccentric shaft 4 has its lower end secured to the stationary side frame 1. An arm 7 has one end secured to the small-diameter shaft 5 and the other end coupled to a link 8. When the link is moved by means of a crank mechanism (not shown) to turn the small-diameter shaft 5, the shaft 3 will turn around the eccentric shaft 4, so that the movable side frame 2 can be moved up or down.

A plate cylinder 9 is rotatably mounted on the shaft 3. By transmitting rotation to a gear 10 secured to one end of the plate cylinder 9, the plate cylinder will turn around the shaft 3. A tubular body 12 is slidably mounted on the shaft 3 to be disposed between end plates 11 of the plate cylinder 9. A bracket support block 13 (FIG. 2) in the form of a square tube mounted on the tubular body 12 has its ends supported on the shaft 3 so as to be rotatable and axially slidable. The block 13 engages the tubular body 12 in an axial direction, but not in the direction of rotation. Thus, when the tubular body 12 moves axially, the block 13, too, moves together with it.

A bracket 15 is mounted on a flat surface 14 of the block 13. (FIG. 2) The length between the ends of the bracket 15 is substantially equal to the inside measurement between the end plates 11 of the plate cylinder 9, but can be slid into the plate cylinder 9 through an opening 16 formed in the outer periphery of the plate cylinder. A slight gap 17 (FIG. 1) is formed between the ends of the bracket 15 and the end plates 11 of the plate cylinder 9 to allow the bracket 15 to be mounted into the plate cylinder. Thus, the bracket 15 can be slid axially only within the slight gap 17.

Figure 5:
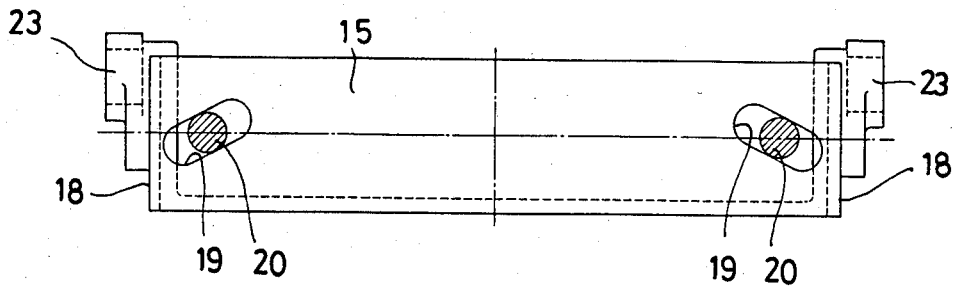
FIG. 5 is a bottom view of the bracket in the mechanism of FIG. 1.

In the preferred embodiment, as shown in FIG. 5, the bracket 15 has its end surfaces 18 formed to be arcs or parts of a circle having its center at the middle of the bracket. The bracket 15 has a pair of oblique grooves 19 (FIGS. 1 and 5) formed at its ends to receive pins 20 formed on the bracket support surface 14 of the block 13. The grooves 19 are oblique in opposite directions.

The bracket 15 is formed on its each end with a projection 21 (FIGS. 1 and 2), which is slidably received in a guide hole 22 formed in the end plate 11 of the plate cylinder 9 to prevent the bracket 15 from getting off the bracket support surface 14 on the block 13. The guide holes 22 are elongated to allow the bracket 15 to incline.

The bracket 15 is formed at its each end with a support piece 23 for supporting the end of a claw support shaft 24 on which a claw 25 is mounted. (FIG. 2) A projection 26 is secured to the bottom of the claw support shaft 24. A pin 27 has one end coupled with the projection 26 and the other end slidably received in a hole 28 formed in the bracket 15. A spring 29 is mounted on the pin 27 to urge the tip of the claw 25 against an anvil 30 integrally formed on the bracket 15.

As the claw support shaft 24 is turned, the tip of the claw 2 moves toward and away from the anvil 30. The tip of a printing plate A is clamped between the claw 25 and the anvil 30. The claw 25 has a stopper 31 to limit the length for which the printing plate A gets therebetween. The claw support shaft 24 may be adapted to be turned either by hand or by means of a cam mechanism to clamp or release the printing plate.

The shaft 3 for supporting a plate cylinder has a hole 32 (FIG. 1) which is open at one end of the shaft 3 to slidably receive a twist adjust shaft 33. Also, the shaft 3 is formed with a radial guide hole 34 to receive a coupling shaft 35 for coupling the twist adjust shaft 33 with the tubular body 12. As the twist adjust shaft 33 is moved axially, the tubular body 12 moves together with it.

Figure 3:
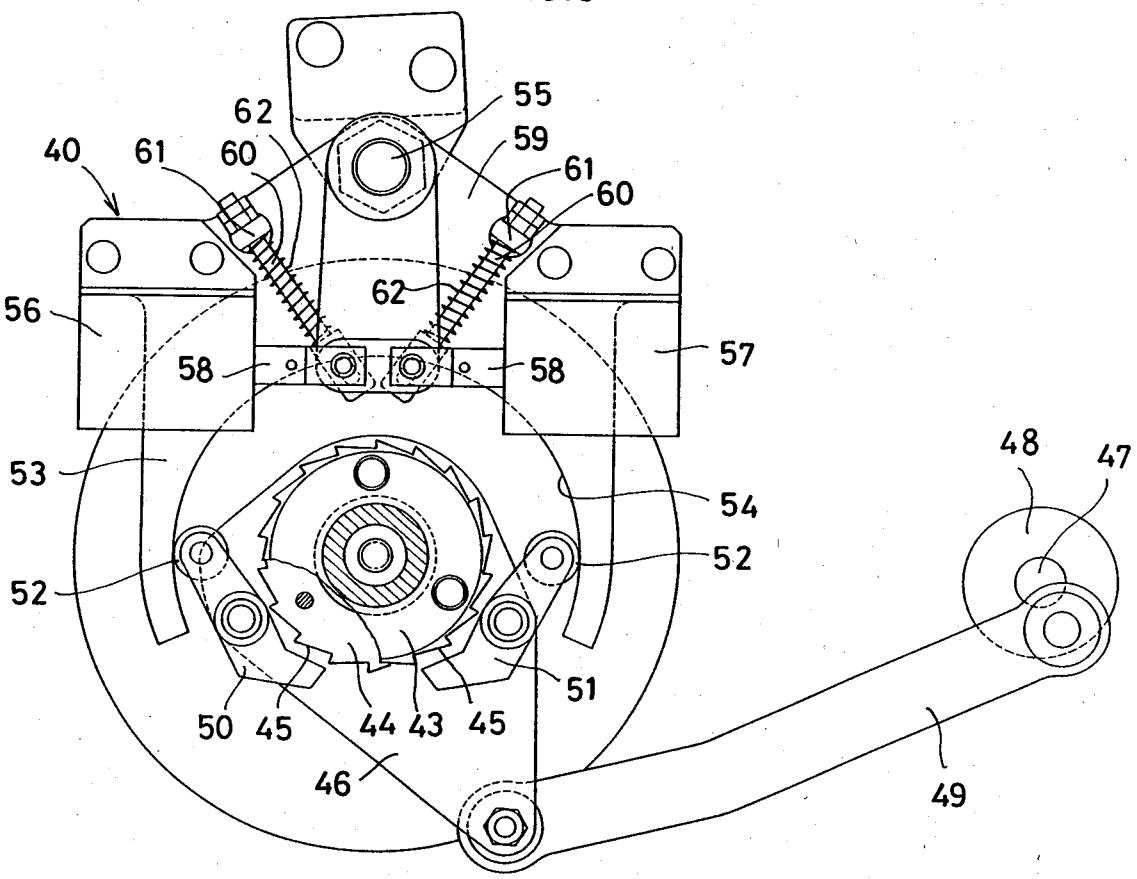
FIG. 3 is a sectional view taken along the line III—III in FIG. 1.

The twist adjust shaft 33 is moved axially by means of a moving mechanism 40, which as shown in FIGS. 1 and 3, comprises a threaded tube 41 formed at one end of the small-diameter shaft 5. The twist adjust shaft 33 has other end projecting from the end of the threaded tube 41 and having a thread 42 opposite in direction to the thread on the threaded tube 41. A pair of ratchet wheels 43, 44 are screwed on the thread 42 and the threaded shaft 41, respectively. They are coupled with each other with their gear 45 facing in opposite directions.

A claw support plate 46 is rotatably supported on the end of the small-diameter shaft 5 and has its lower end coupled by a link 49 with a disc 48 (FIG. 3) fixedly mounted on a suitable rotary shaft 47 of the printing machine. A pair of claws 50, 51 disposed at sides of the ratchet wheels 43, 44 are rotatably mounted on the claw support plate 46. The claws 50, 51 are biassed by springs (not shown) so that rollers 52 mounted on the rear end of the claws will be kept butting against the inner wall of a round hole 54 formed in a solenoid support plate 53.

The solenoid support plate 53 has its upper portion rotatably supported by a support shaft 55 mounted on the outer side of the movable side frame 2. A pair of solenoids 56, 57 are mounted on the solenoid support plate 53 and each has a plunger 58. The plungers are coupled to the lower portion of a coupling piece 59 which has its upper portion secured to the support shaft 55. A pair of rods 60 have one end coupled to the bottom of the coupling piece 59 at each side thereof and the other end slidably supported on projections 61 rotatably mounted on the solenoid support plate 53 at each side thereof. Springs 62 mounted on the rods 60 serve to keep balance of the solenoid support plate 53 so that the claws 50, 51 will get off the gears 4 of the ratchet wheels 43, 44.

In operation, a printing plate A is wound around the plate cylinder 9 with its end clamped between the claw 25 and the anvil 30. (FIG. 2) In case the printing plate A is twisted, the moving mechanism 40 is actuated to move the twist adjust shaft 33 axially.

Figure 4:
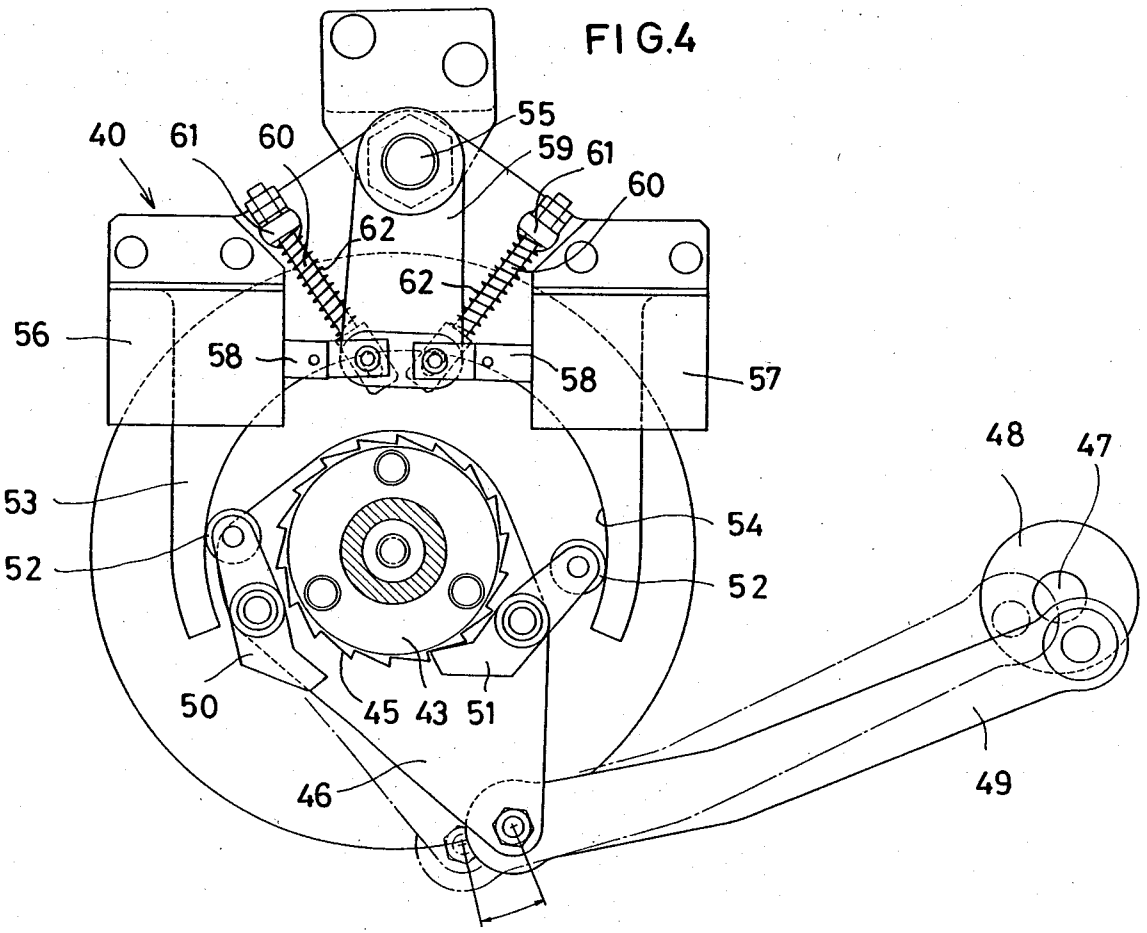
FIG. 4 is a view similar to FIG. 3 for showing operation.

When the start switch of the printer is turned on, the rotary shaft 47 will turn in one direction, so that the claw support plate 46 will turn around the small-diameter shaft 5 for a preset angle. (FIG. 4) At this time, if one solenoid 56 of two solenoids 56, 57 supported on the solenoid support plate 53 is energized to excite the plunger 58, the solenoid 56 will move with respect to the plunger 58 which is fixed, so that the solenoid support plate 53 will turn around the shaft 55.

This means that the inner wall of the round hole 54 formed in the solenoid support plate 53 moves away from the roller 52 on the claw 51, so that the claw 51 will engage the gear 45 on the ratchet wheel 43. As a result, the ratchet wheels 43, 44 will turn intermittently in one direction and the twist adjust shaft 33 threadedly engaging the ratchet wheel 43 will move in an axial direction. In a similar manner, if the solenoid 57 is energized to excite the plunger 58, the ratchet wheels 43, 44 will turn in the reverse direction, so that the twist adjust shaft 33 will move in the reverse direction.

With the axial movement of the twist adjust shaft 33, the tubular body 12 coupled to the shaft 33 through the coupling shaft 35 moves axially along the plate support shaft 3. Also, the bracket support block 13 engaging the tubular body 12, too, moves axially along the cylinder support shaft 3.

Figure 6:
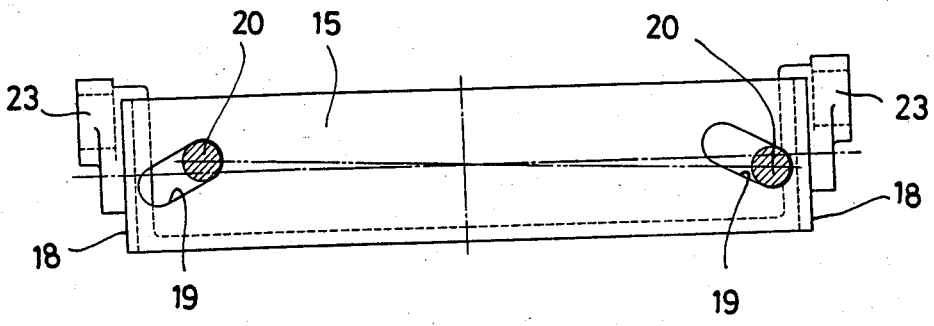
FIG. 6 is a view similar to FIG. 5 for showing operation.

As the block 13 moves axially, the bracket 15 tends to move axially since a pair of pins 20 on the block 13 are received in a pair of the oblique grooves 19 formed in the brackets (FIG. 6). But, because one end of the bracket 15 butts against the inner face of the end plate 11 of the plate cylinder 9, the bracket will be prevented from moving axially. As the block 13 moves axially further with respect to the bracket 15, the bracket will skew as shown in FIG. 6, while the pins 20 move in the oblique grooves 19. If the pins 20 move rightwardly in condition shown in FIG. 5, the bracket 15 will skew as shown in FIG. 6. If they move leftwardly, the bracket will skew in the reverse direction.

Since the tip of the printing plate A is held by the claw 25 provided on the bracket 15, the plate A will skew as the bracket 15 skews. By this arrangement, if a pattern on the plate A is twisted, such a twist can be corrected by skewing the bracket 15 by the amount corresponding to the degree of twist.

Figure 7:
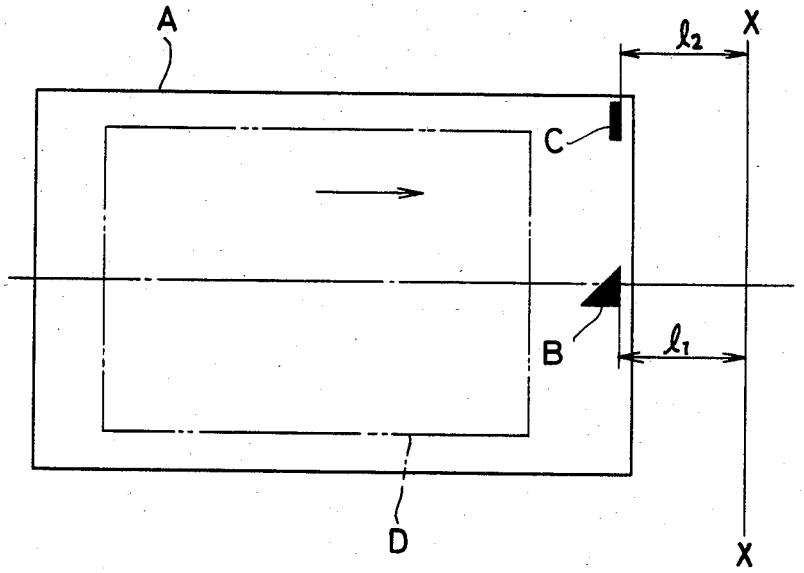
FIG. 7 is a view for explaining how automatic adjustment of twist is performed.

As shown in FIG. 7, a pair of register marks B and C may be put on the printing plate A in its center and at one end thereof, respectively, at positions corresponding to a pattern D on the printing plate A. By comparing the distances $l_1$, $l_2$ from a reference line X—X to the register marks B, C with each other, it can be determined how much the plate A and thus the pattern D are twisted.

A reference position detector is provided on a part rotating in synchronization with the plate cylinder, and a reference pulse generator is provided. The signal from the reference position detector and the signal from the reference pulse generator are given to first and second counters to count the pulses. On the other hand, first and second detectors for detecting the register marks B and C, respectively, are provided around the plate cylinder. The signals from the first and second detectors are given to the first and second counters, respectively, to stop their counting. The signals from the two counters are given to a comparator/computer, the signal from which is used to control the solenoids 56, 57 supported on the solenoid support plate 53.

Although in the preferred embodiment the pins 20 are formed on the block 13 and the grooves 19 are formed in the bracket 15, pins may be formed on the bracket and grooves be formed in the block.

Mechanism for axially moving the twist adjust shaft 33 is not limited to the one illustrated and described above. Any other mechanism will do.

Although in the preferred embodiment the plate cylinder 9 is rotatably mounted, the present invention is applicable to printing machines on which the plate cylinder turns integrally with the plate support shaft 3, too.

What we claim:

1. Mechanism for correcting the twist of a plate on a printing machine having a plate cylinder, said mechanism comprising:

a cylinder support shaft for supporting said plate cylinder;

a bracket having a claw for clamping the plate at one end thereof;

a block for supporting said bracket, said block being mounted on said cylinder support shaft so as to be rotatable and slidable in an axial direction;

said bracket being supported on said block with a slight gap left between the ends of said bracket and the inner faces of said plate cylinder to allow said bracket to be skewed;

one of said bracket and said block being formed with a pair of grooves oblique in opposite directions and the other being formed with a pair of pins adapted to be received in said pair of oblique grooves;

a twist adjust shaft mounted in said cylinder support shaft and coupled with said block so that said block is axially movable when said twist adjust shaft is moved axially; and means for moving said twist adjust shaft axially.

* * * * *